United States Patent [19]

Rosner

[11] 3,976,029

[45] Aug. 24, 1976

[54] LIQUID ADHESIVE APPLICATOR

[75] Inventor: George Rosner, Newport, R.I.

[73] Assignee: The United States of America as represented by the Secretary of the Army, Washington, D.C.

[22] Filed: Sept. 17, 1975

[21] Appl. No.: 614,713

[52] U.S. Cl. ..... 118/215; 118/218; 118/232

[51] Int. Cl.[2] ..... B05C 1/02; B05C 7/00

[58] Field of Search ..... 118/219, 215, 218, 232, 118/233; 427/231; 228/48, 30, 31

[56] References Cited

UNITED STATES PATENTS

| | | | |
|---|---|---|---|
| 2,447,528 | 8/1948 | Paynter | 118/218 X |
| 2,791,983 | 5/1957 | Driskell | 118/219 |
| 3,185,130 | 5/1965 | Pratt | 118/228 |

*Primary Examiner*—John P. McIntosh
*Attorney, Agent, or Firm*—Nathan Edelberg; A. Victor Erkkila; Ronald M. Spann

[57] ABSTRACT

A device for applying a film of liquid adhesive to the inside lip surface of a cylindrical cap includes a vessel containing a body of liquid adhesive, a means, e.g., a drive plate, for rotating the cylindrical cap and one or more rotatable knurled wheels or discs which touch the liquid adhesive and resiliently contact the inside cap surface, whereby the wheel is rotated by rotation of the cap and applies the adhesive to the cap.

Magnets in the drive plate attract magnets in the knurled wheels sufficient to constantly turn the wheels when they are not being resiliently pressed against the inner surface of the cap.

6 Claims, 1 Drawing Figure

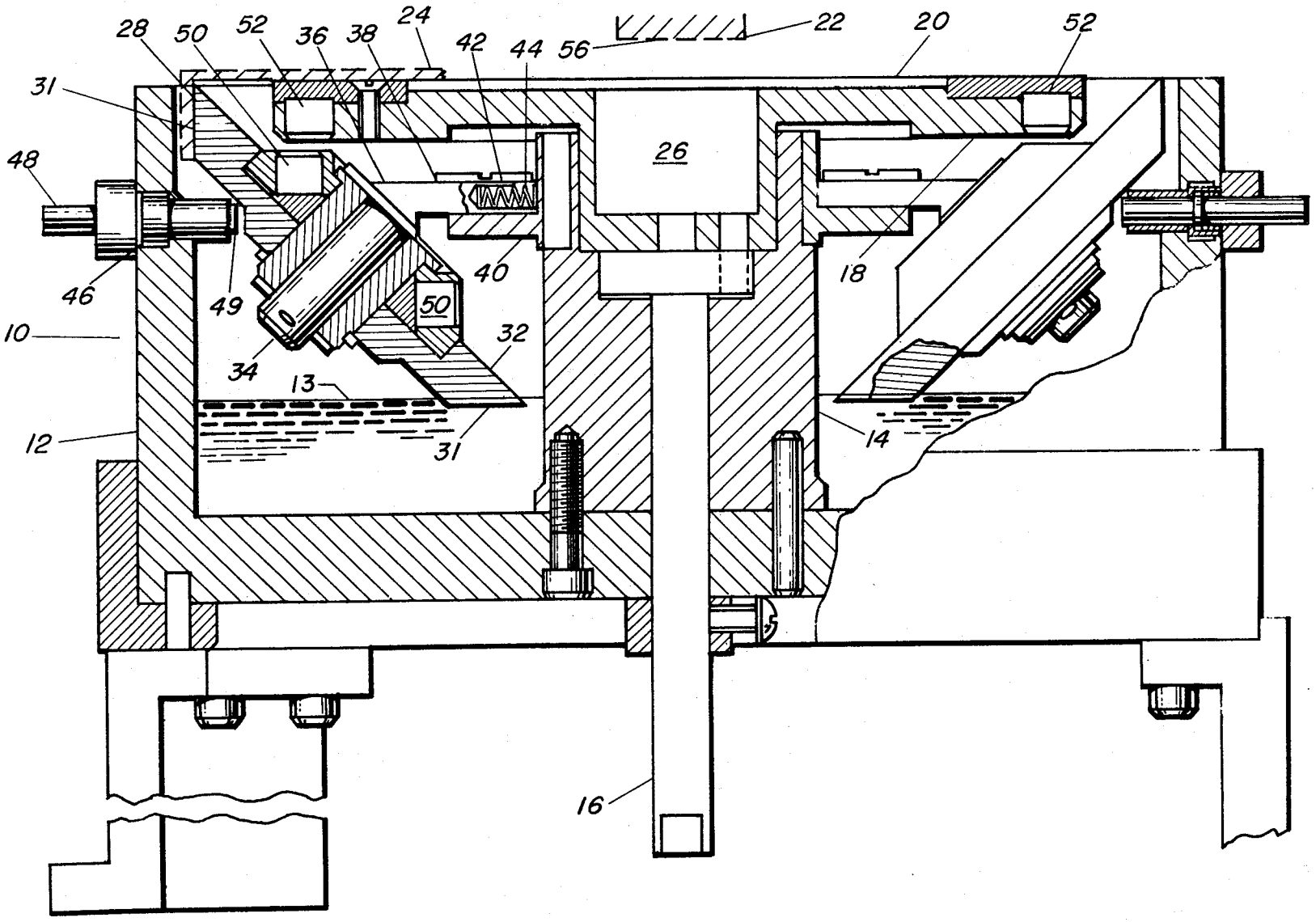
52
20
22
56
24
52
28
31
48
46
10
12
26
18
14
16
44
42
38
36
50
40
32
31
50
13
34
49

LIQUID ADHESIVE APPLICATOR

GOVERNMENTAL INTEREST

The invention described herein may be manufactured, used and licensed by or for the Government for governmental purposes without the payment to me of any royalty thereon.

BACKGROUND OF THE INVENTION

The invention solves the problem of applying a highly viscous liquid adhesive, such as nitrocellulose solution, which is sensitive to heat, friction and impact, dries very rapidly and forms a tacky layer on its surface, even as it is being applied, due to the high evaporation rate of the solvent. These factors create great difficulty when attempting to apply the adhesive automatically by ordinary means utilizing brushes, pumps, drip trays, and air power paint guns.

The present method of application utilizes a brush held by an operator to spread the adhesive which is applied by hypodermic syringe to the base by another operator. The present method is costly requiring several operators doing different chores to insure the proper application of the adhesive.

By utilizing the invention in place of the conventional hypodermic syringe and brushing operation, application time is more rapid. Further, there is no loss of adhesive in application and the adhesive is applied exactly in the location required for the item.

SUMMARY OF THE INVENTION

In accordance with the present invention, there is provided a novel device for applying a film of liquid, e.g., a nitrocellulose adhesive, to the inside lip surface of a cylindrical cap and the like. The device includes a vessel which contains a means for rotating the cap, e.g., a drive plate, and one or more rotatable knurled discs or wheels, which are mounted in said vessel so as to touch the liquid and resiliently contact the inside cap lip surface, whereby the knurled wheels are rotated by rotation of the cap. The knurled wheels and the drive plate are also provided with magnetic means, e.g., by magnets mounted thereon, which form a magnetic field, whereby the knurled wheels are turned without mechanical contact when they are not resiliently pressed against the inside lip surface for rotation. The novel device thus avoids the hazards involved in applying nitrocellulose and similar friction sensitive adhesives by use of a mechanical drive, which is in contact with such adhesive, particularly if dried films thereof are formed on metal to metal contact surfaces. Further, since the knurled wheels are constantly rotating into and out of the liquid to be applied, a self-cleaning of the applicator wheels is sustained.

BRIEF DESCRIPTION OF THE DRAWING

The drawing illustrates a diagrammatic section view of the liquid applicator device with the workpiece being shown by a dotted outline.

DESCRIPTION OF THE PREFERRED EMBODIMENTS

Referring to the drawing, in which like reference characters refer to like parts throughout the figure, 10 designates the liquid adhesive applicator comprising a cylindrical vessel 12 filled with a liquid adhesive, e.g., a highly viscous (8000 centipoises) nitrocellulose solution, to level 13 and provided with a central support 14 for a vertical drive shaft 16 which is continuously turned by an air motor (not shown). To the top of the shaft 16 is fixedly attached a horizontal drive plate 18, on which a spring loaded lift 20 is seated. When not loaded by the vertical ram 22, the spring loaded lift 20, which supports cap 24, is urged to the raised position by a spring (not shown) housed in a cup 26 in the center of the drive plate 18 such that the lip 28 of cap 24 does not contact the knurled rim 31 of wheel 32.

Each wheel 32 is rotatably mounted at a 45° angle from the vertical on an axle 34 and possesses a knurled rim 31 having a 45° angle to the plane of rotation of the wheel. The axle 34 is provided with a flat, 45° angle extension 36, which is slidably mounted in a slot 38 in bracket 40 affixed to the central support 14. The end of axle extension 36 has a cavity 42 containing a compression spring 44, which presses against the bracket 40 and urges the axle and wheel 32 outward. Container sidewall bore 46 aligned with each wheel contains a slidably mounted pin 48, which can be pushed inward by means of an air cylinder (not shown) to contact and force the wheel 32 radially inward sufficient to permit insertion of the cap lip 28 past the knurled wheel rim 31. Pin 48 terminates in a roller bearing 49, which permits continued rotation of wheel 32 when the latter is forced inward by said pin. When pin 48 is retracted, the resiliently mounted wheel 32 is urged outwardly by compression spring 44 sufficient to contact the inside surface of lip 28 of cap 24, which is rotated by engagement with drive plate 18, and hence imparts rotation to the wheel 32.

Mounted in magnetically complementary position in both the knurled wheel 32 and drive plate 18 are permanent magnets 50 and 52 respectively such that a torque due to the magnetic field is constantly exerted on each wheel 32 due to the presence of the permanent magnets in each wheel and the constantly turning drive plate 18.

Shown diagrammatically in dotted outline form above the drive plate is the vertical ram 22 having a horizontal, rotatable face 56 whose axis of rotation is coincident the axis of rotation of the drive plate 18.

The sequence of operation is as follows:

a. Operator places the cap 24 on the spring loaded lift 20.

b. Operator depresses an air operated switch (not shown) which activates the ram 22 to move cap 24 on spring lift plate 20 into contact with the applicator drive plate 18, which is continuously rotated by an air motor through shaft 16, and simultaneously activates air cylinders (not shown), which force pins 48 radially inward, thereby moving the wheel 32 radially inward which provides clearance between the inside face of the lip 28 of the cap 24 and the knurled rim 31 of wheel 32. Subsequently and sequentially a timing device reverses action on the air cylinders, which withdraws pins 48 and permits springs 44 to force applicator wheels 32 radially outward to bear against the inside lip 28 of the cap 24. Upon the mechanical locking of the knurled surface of applicator wheel 32 with lip 28 of cap 24, the applicator wheel 32 is caused to rotate. The rotating wheel with knurled rim 31, which touches the liquid adhesive, lifts the adhesive and applies it to the lip 28 while the cap 24 rotates. After one-half revolution of the cap 24, the timer (not shown) causes the ram 22 to be lifted at a rate proportional to the rotational speed of the cap 24, such that when the cap 24 completes an additional one-half revolution, the cap 24 spirals out of the applicator wheels 32 and is freely supported on the lift 20. The ram 22 proceeds upward such that the operator can remove the cap 24 from the applicator's spring-loaded lift 20 assembly.

The foregoing disclosure and drawing are merely illustrative of the principles of this invention and are not to be interpreted in a limiting sense. I wish it to be understood that I do not desire to be limited to exact details of construction shown and described, because obvious modifications will occur to a person skilled in the art.

What is claimed is:

1. A device for applying a film of liquid adhesive to the inside lip surface of a cylindrical cap, which comprises:

a vessel containing said liquid adhesive;

a knurled wheel rotatably and resiliently mounted in said vessel adapted to contact said inside cap lip surface and said liquid;

means for rotating said cap, whereby rotation of said cap causes the knurled wheel in resilient contact therewith to rotate and thereby apply said liquid to said lip surface; and magnetic means for rotating said knurled wheel when said wheel is not rotated by rotation of said cap.

2. The device of claim 1, wherein the magnetic means for rotating said knurled wheel comprises magnets mounted in said wheel and magnets mounted in said cap rotating means.

3. The device of claim 2, wherein the cap rotating means comprises:

a drive plate containing said magnets;

a ram for releasably engaging said cap to said drive plate;

a spring lift plate seated on said drive plate for raising said cap sufficient to remove said cap lip from contact with said knurled wheel and thereby permit removal of the cap when said ram is disengaged from said cap.

4. The device of claim 3 comprising a plurality of knurled wheels, wherein each knurled wheel rotates on an axle, said axle being slidably and radially mounted on a central support means in said vessel and containing a spring biasing means, whereby said wheel is resiliently contacted with said cap lip surface.

5. The device of claim 4, wherein the vessel contains in alignment with each wheel a slidable pin, which can be moved against said wheel to displace said wheel radially inward sufficient to permit insertion of said cap lip and removal thereof from contact with said wheel.

6. The device of claim 5, wherein the wheel rotates at an angle of 45° with respect to the liquid and contains a flat knurled rim having a 45° angle with respect to the plane of rotation of the wheel, whereby said knurled rim is parallel to said liquid surface and said cap lip surface.

* * * * *